United States Patent [19]

Flaherty

[11] 3,997,993

[45] Dec. 21, 1976

[54] FLAG WAVING UNIT

[76] Inventor: Edward J. Flaherty, 5219 Lake Arrowhead Drive, Waco, Tex. 76710

[22] Filed: July 2, 1975

[21] Appl. No.: 592,543

[52] U.S. Cl. ..... 40/218; 116/174

[51] Int. Cl.[2] ..... G09F 17/00

[58] Field of Search ..... 40/218, 37, 128, 145 R, 40/125 G, 125 J; 116/174, 173

[56] References Cited

UNITED STATES PATENTS

| | | | |
|---|---|---|---|
| 1,254,524 | 1/1918 | Mink | 116/173 |
| 2,409,411 | 10/1946 | Zedler | 116/173 |
| 2,681,030 | 6/1954 | Hoge | 116/173 X |
| 2,881,543 | 4/1959 | De Rouen | 40/125 J |
| 3,327,419 | 6/1967 | Stanos | 40/124 |
| 3,571,999 | 3/1971 | Downing | 40/125 H |
| 3,798,816 | 3/1974 | Flaherty | 40/218 |

*Primary Examiner*—John F. Pitrelli
*Attorney, Agent, or Firm*—Bacon & Thomas

[57] ABSTRACT

An improved flag waving unit for supporting a flag and causing the same to flutter, and including a rotatably-attached support for the flag whereby the flag may be maintained in a substantially vertical orientation when the unit is not in use to preclude wrinkling or other distortion of the flag material.

4 Claims, 5 Drawing Figures

Fig. 1.
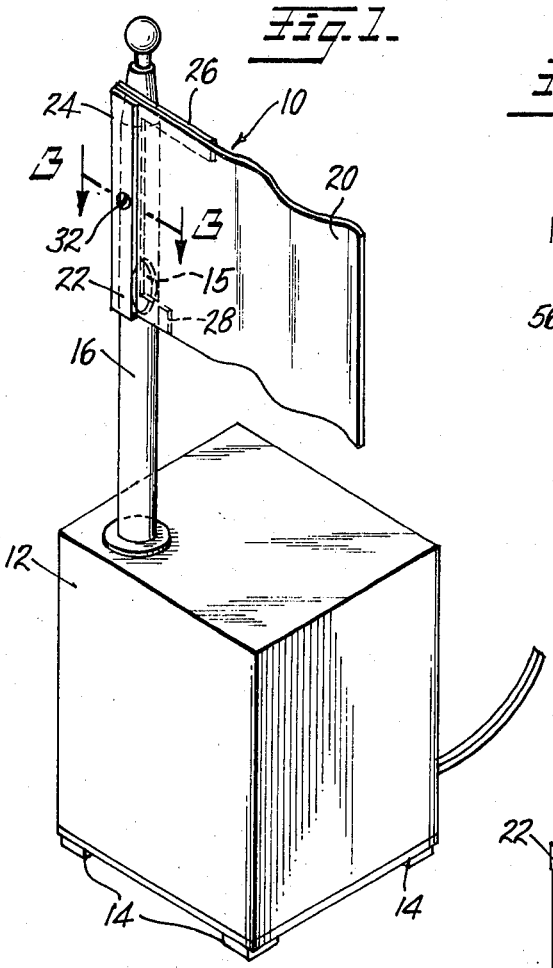
Fig. 4.
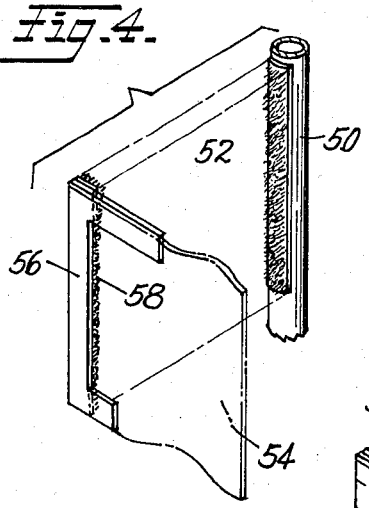
Fig. 5.
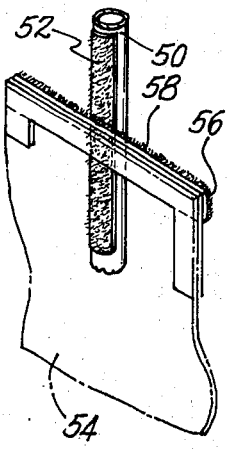
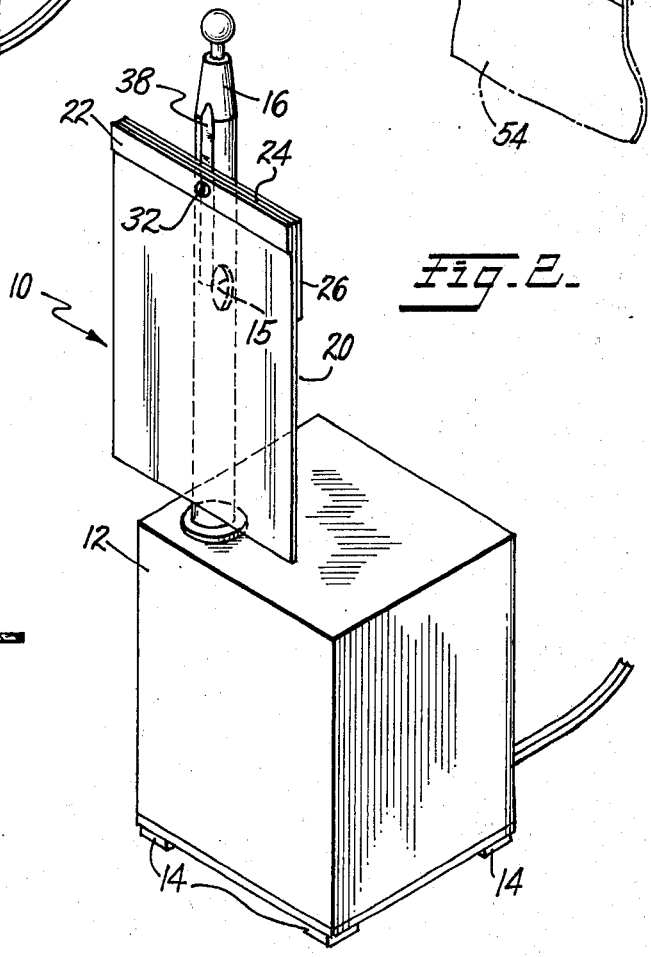
Fig. 2.
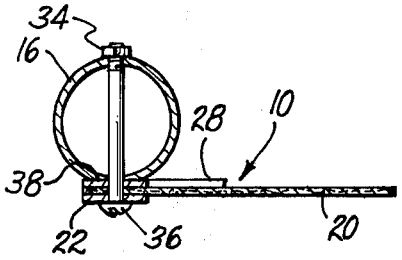
Fig. 3.

FLAG WAVING UNIT

BACKGROUND OF THE INVENTION

1. Field of the Invention

The present invention relates to flag waving units incorporating means for generating a flow of air whereby the flag is caused to flutter in an artificial wind. More specifically, the present invention relates to an improvement over my U.S. Pat. No. 3,798,816 and includes a rotatablyattached support for the flag whereby the flag may be disposed in a substantially vertical direction when the unit is not in use, thereby precluding the formation of wrinkles or other distortions in the flag material which would result in an imperfect fluttering thereof.

2. Description of the Prior Art

The prior art recognizes various means to create an artificial wind in conjunction with a flag waving unit whereby the flag is caused to flutter. My earlier U.S. Pat. No. 3,798,816, incorporated herein by reference and relied upon, discloses one such device whereby a flow of air is caused to traverse the internal dimension of a tubular or otherwise hollow staff, exit through apertures therein, and impinge upon the flag. In order to enhance the fluttering effect, a U-shaped support clip is provided to carefully position the flag in the stream of flowing air.

While my earlier U.S. patent successfully provides a device for effecting the waving of a flag in an artificial wind, I have discovered that the flag material has a tendency to develop wrinkles or other distortions when the unit is not in use and the flag hangs from the support clip yielding a drape in the material. Accordingly, the need exists to provide means to prevent such wrinkling or distortion but which will not interfere with the successful operation of the flag waving unit.

SUMMARY OF THE INVENTION

In accordance with the foregoing need, it is the major object of the present invention to provide means to mitigate or entirely prevent the formation of wrinkles or distortions in the flag material when the flag waving unit is not in operation.

In accordance with the present invention, it has been determined that the foregoing object and advantages may be realized by pivotally securing the supporting clip for the flag about a rotatable hinge means whereby the flag may be rotated into a substantially vertical position when the unit is not in use. This will prevent an undesirable drape in the fabric, and accordingly, prevent the formation of wrinkles or other distortions therein.

BRIEF DESCRIPTION OF THE DRAWINGS

The foregoing and other objects of the present invention will become apparent upon an examination of the following detailed description when taken in conjunction with the appended figures of drawing, wherein:

FIG. 1 is a perspective view of the flag waving unit according to the present invention;

FIG. 2 is a perspective view, similar to FIG. 1, but showing the flag at rest when the unit is not in operation;

FIG. 3 is an enlarged cross-sectional view taken substantially along line 3—3 of FIG. 1.

FIG. 4 is a fragmentary, exploded perspective view of an alternate embodiment of the present invention; and FIG. 5 is a fragmentary perspective view, similar to FIG. 4, but showing the flat at rest when the unit is not in operation.

DETAILED DESCRIPTION OF THE INVENTION

In order to more fully demonstrate the objects and advantages of the present invention, the following detailed description will be given in terms of a certain preferred embodment thereof, the same being intended as illustrative and in no wise limitative.

FIG. 1 illustrates the flag waving unit according to the present invention, designated generally as 10, while the flag is subjected to the flow of artificial wind. The unit is comprised of a base section 12 which integrally houses the source of the flowing airstream. Base 12 is supported upon a plurality of rubber legs 14 in order to stabilize the unit against vibration as well as provide a space from which to draw air by means of a fan (see U.S. Patent No. 3,798,816). Vertically disposed from base 12 is a staff 16 which is of hollow design, the lower, open end thereof operatively communicating with the source of forced air. A single aperture 15 is formed in the upper section of staff 16 and is oriented in such a fashion that the flow of air from within the internal dimension of staff 16 is caused to impinge upon a flag 20 in a precise fashion.

Flag 20, which is made of any suitable material such as silk, is borne upon a substantially U-shaped clip designated generally as 22. Clip 22 has a central arm 24 whose length is substantially equal to the width of flag 20. The clip also has an upper arm 26 and lower arm 28 for supporting the flag along the longitudinal edges thereof. The flag is adhesively or otherwise attached to clip 22.

Clip 22, with flag 20 securely attached thereto, is pivotally supported upon staff 16 about rotatable hinge 32. Hinge 32 may be of various, diverse designs, provided, however, the clip 22 is capable of rigidly securing the flag in the position shown in FIG. 1 when the device is in operation. While various rotatable hinges are known in the art, it has been found that a simple nut and bolt, designated 34 and 36, respectively, achieves the objects of the present invention.

As shown in FIG. 1, with the blower in operation, the flag will flutter under the influence of artificial wind generated within base member 12. While the upper and lower arms of the clip, 26 and 28, respectively, will adequately support the flag 20 while in operation, and will also provide a certain amount of support to the flag when the unit is deenergized, ther is a pronounced tendency of the flag material to drape when the unit is not in use. Over a course of time, any wrinkling or distortion of the flag material will become enhanced as the folds will preferentially align in certain directions. Therefore, after extended periods of use of the device, it will become necessary to replace the flag.

However, by virtue of rotatable hinge means 32, this requirement is precluded. When the device is not in use, one may simply rotate clip 22 about hinge means 32 so that the flag takes on a substantially vertical orientation as depicted in FIG. 2. Accordingly, when the device is not in operation, the flag will hang in such a fashion that no wrinkles or other distortions are caused to be established. In order to insure that the clip 22, and thus the flag, maintains its proper orientation during operation, there is provided a flat 38, best viewed in FIG. 3. The dimensions of flat 38 correspond to those of central arm 24 of clip 22. Thus, the central arm 24 and flat 38 cooperate in a manner analogous to a detent whereby the flag is securely maintained in proper orientation while the device is in operation.

Not only does rotatable hinge 32 preclude the formation or wrinkles or distortions in the flag material, it facilitates the changing of various flags. Numerous flags, such as the American flag or those bearing various company logos, may freely be interchanged on staff 16 by simply removing clip 22 therefrom and resecuring a new flag on the staff about rotatable hinge 32.

As noted above, there is provided a single aperture 15, from which the flow of air emanates in a precise fashion. As best viewed in FIG. 1, the upper and lower arms, 26 and 28, of clip 22 are designed so that the former is longer than the latter. When flag 20 is supported upon clip 22, there exists a line of stress extending along the line drawn from the end points of arms 26 and 28. The flow of air from aperture 15 is caused to pass along this line of stress thus effecting perturbation thereof. This perturbation gives rise to a slow and uniform waving of flag 20 closely resembling the waving of a flag in an ordinary breeze. In contradistinction to prior art devices having a plurality of apertures directing the artificial wind longitudinally along the flag, the waving effect in accordance with the present invention provides a three-dimensional fluttering of the entire flag, not only the terminal extremity thereof.

FIGS. 4 and 5 illustrate another embodiment of the present invention wherein rotatable hinge means 32 is replaced with a fabric fastening assembly to facilitate the changing of the flag from an operable to an inoperable position. In the embodiment depicted in FIGS. 4 and 5, a staff 50 has adhered thereto a first element 52 of a fabric fastening assembly. A flag 54 is adhesively or otherwise attached to a substantially U-shaped clip 56 which supports a mating element 58 of the fabric fastening assembly. The fabric fastening assembly, 52, 58, consists of fabric support members each bearing cooperating elements which interpenetrate to establish a mechanical interlocking therebetween. Suitable materials are commercially available under the trademark "VELCRO".

The embodiment of FIGS. 4 and 5 operates identically with that of FIGS. 1-3, save for the rotatable hinge feature of the latter. In this alternate embodiment, the flag is firmly held in the operable position, analogous to that of FIG. 1, by means of the fabric fastening assembly, 52, 58. When it is desired to place the flag in the inoperable position shown in FIG. 5, similar to that of FIG. 2, the user need merely remove the flag by application of sufficient pressure to release mechanical interlocking between mating parts 52 and 58, manually rotate the flag, and attach the flag as shown in FIG. 5 by merely pressing the mating portions of the fabric fastener together.

While the invention has now been described in terms of a preferred embodiment thereof, the skilled artisan will appreciate that various modifications, substitutions, omissions, and alterations may be made without departing from the spirit thereof. Accordingly, it is intended that the scope of the invention be limited only by the following claims.

I claim:

1. A flag waving device comprising:

a. a substantially vertical staff having an upper and a lower end and means for supporting a flag at the upper end of said staff;

b. a clip having a central arm, said flag being attached to said clip;

c. said support means comprises rotatable hinge means securing said clip to said staff for preventing wrinkling of said flag when the device is not in use, whereby said flag is selectively positionable in either an inoperable position wherein said central arm is substantially horizontal and said flag hangs in a downward direction therefrom, or in an operable position wherein said central arm is substantially vertical and said flag waves outward therefrom; and, d. an elongated flat section formed in said staff at said upper end, said flat section located in registry and co-extensive with said central arm when in said operative position, whereby said flag is rigidly secured in said operative position.

2. The flag waving device of claim 1, wherein said rotatable hinge is comprised of a nut and a bolt.

3. The flag waving device of claim 1, wherein said clip is U-shaped and said central arm forms the bight, and including upper and lower arms attached to said central arm.

4. The flat waving device of claim 3, wherein said staff is hollow and has an aperture formed therein proximate the lower end of said flag, and wherein said central arm has a length substantially equal to the width of said flag, whereby said upper and lower arms attach to said flag along a portion of the longitudinal edges thereof, said device further comprising:

a. means for generating a flow of air; and b. means for directing said flow of air to the lower end of said staff, whereby said flow of air is caused to traverse the internal dimension of said staff, exit through said aperture, and impinge upon said flag.

* * * * *